United States Patent [19]

Bell

[11] 4,406,372

[45] Sep. 27, 1983

[54] DISPLAY TRAY

[76] Inventor: Thomas L. Bell, 7300 NW. 23rd St., Suite 405, Bethany, Okla. 73008

[21] Appl. No.: 375,193

[22] Filed: May 5, 1982

[51] Int. Cl.[3] ..... B65D 1/34; A47F 7/024

[52] U.S. Cl. ..... 206/566; 206/560; 206/565; 206/493; 211/59.1

[58] Field of Search ..... 206/558, 560, 565, 566, 206/493, 303, 483; 211/59.1, 60 T; 312/136; 248/314

[56] References Cited

U.S. PATENT DOCUMENTS

| | | | |
|---|---|---|---|
| 312,835 | 2/1885 | Friedenthal | 206/566 |
| 507,864 | 10/1893 | Wertheimer | 206/566 |
| 683,998 | 10/1901 | Seidl | 206/566 |
| 3,204,774 | 9/1965 | Barbieri | 206/566 |
| 3,305,190 | 2/1967 | Gans | 211/59.1 |
| 3,473,756 | 10/1969 | Jones | 211/59.1 |
| 3,540,576 | 11/1970 | Pierce et al. | 211/59.1 |

*Primary Examiner*—William T. Dixson, Jr.
*Assistant Examiner*—Brenda J. Ehrhardt
*Attorney, Agent, or Firm*—Robert M. Hessin

[57] ABSTRACT

A display tray for ring jewelry wherein a plurality of parallel bars each having normally extending ring posts are selectively positionable to enable captive retention of rings placed on the ring posts as the free post ends are locked in abutment to a next adjacent bar.

10 Claims, 5 Drawing Figures

DISPLAY TRAY

BACKGROUND OF THE INVENTION

1. Field of the Invention

The invention relates generally to a display tray for small mercantile items that has particular theft-proof attributes and, more particularly, but not by way of limitation, it relates to an improved form of jewelry tray for theft-proof display of rings and other small mercantile items having a ring structure in association.

2. Description of the Prior Art

The prior art includes numerous types of display trays and cases that are especially adapted for small jewelry items, and some of which include certain locking structure that provides theft-proof capabilities. A patent of particular interest is that to Friedenthal, U.S. Pat. No. 312,835, as patented on Feb. 24, 1885, which teaches a spring-loaded structure wherein a plurality of transverse bars each have a plurality of parallel-aligned pins C, and said transverse bars are closely aligned in pin-locking relationship as urged uni-directionally by springs D. Thus, a ring displayed on one of pins C can be loosed by movement of a respective transverse bar or strip B against the springs D. Another U.S. patent in the name of Seidl, U.S. Pat. No. 683,998 as issued on Oct. 8, 1901, discloses a ring tray arrangement wherein rings are captively retained on selected ones of a plurality of ring-holding fingers E, each of which is hingedly retained along a center line through the tray A. U.S. Pat. No. 507,864 and No. 3,204,774 are of interest only in that they exhibit a theft-proof display feature as each utilizes a removable capture rod which extends through the display device while securing a row of ring items as they are prevented from vertical movement.

SUMMARY OF THE INVENTION

The present invention relates to an improvement in secure ring display devices which, through a single turning movement, simultaneously free all rings for removal, replacement, closer observation or the like. The display device consists of a base member having a plurality of parallel base bars secured thereon, each of the bars including a plurality of parallel, generally equally-spaced rod members for receiving the ring or other jewelry item to be displayed. A second plurality of bars, each hingedly connected to the base member, also includes a plurality of generally equally-spaced and parallel rod members, and the hinged bar members are operative to close against the base member with every bar disposed between adjacent pairs of base bars such that the open end of each rod member is proximate an adjacent bar and effectively blocked to prevent removal of a jewelry item. The display device includes locking means as well as support means for enabling selected display and show case attitudes for presentation to the buyer.

Therefore, it is an object of the present invention to provide a ring display tray wherein individual ring items can be displayed in inseparable theft-proof manner.

It is also an object of the present invention to provide an improved display tray wherein unlocking movement of the security elements of the device frees all ring retaining positions simultaneously and completely.

It is yet another object of the present invention to provide a theft-proof display tray which can be constructed securely of relatively inexpensive yet attractive materials.

Finally, it is an object of the present invention to provide a jewelry display tray wherein the size and shape may be freely varied while still retaining the interactive component locking features.

Other objects and advantages of the invention will be evident from the following detailed description when read in conjunction with the accompanying drawings which illustrate the invention.

DETAILED DESCRIPTION OF THE INVENTION

Figure 1:
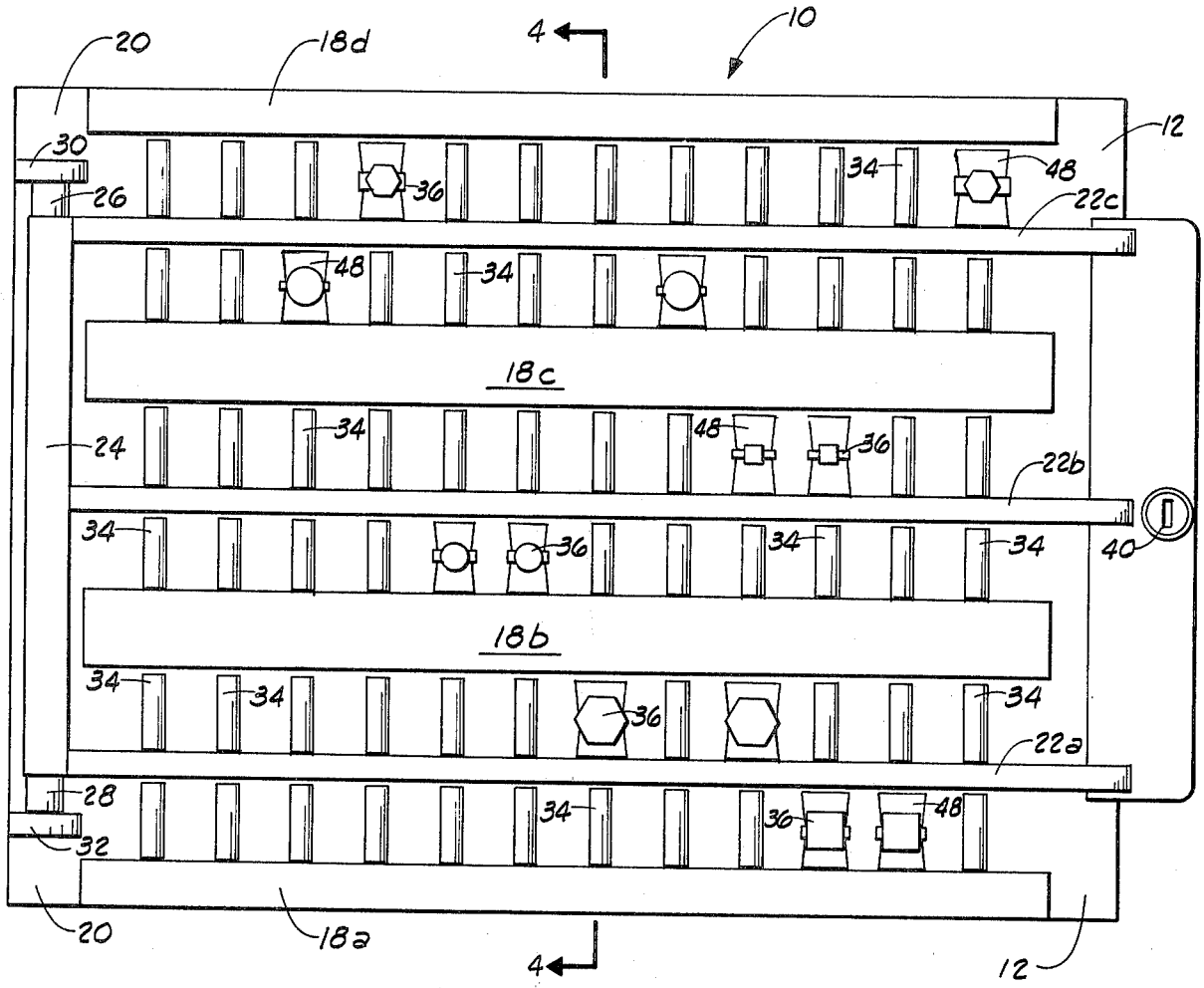
FIG. 1 is a top plan view of a display tray as constructed in accordance with the present invention.
Figure 2:
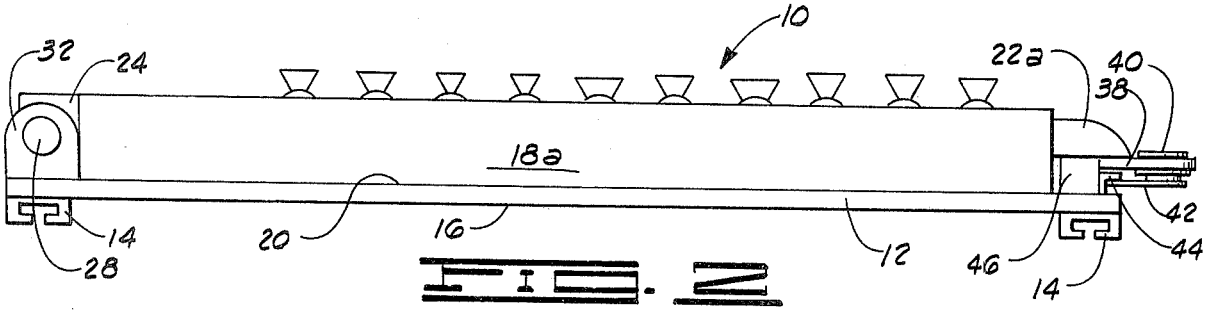
FIG. 2 is a view in front elevation of the device of FIG. 1.
Figure 3:
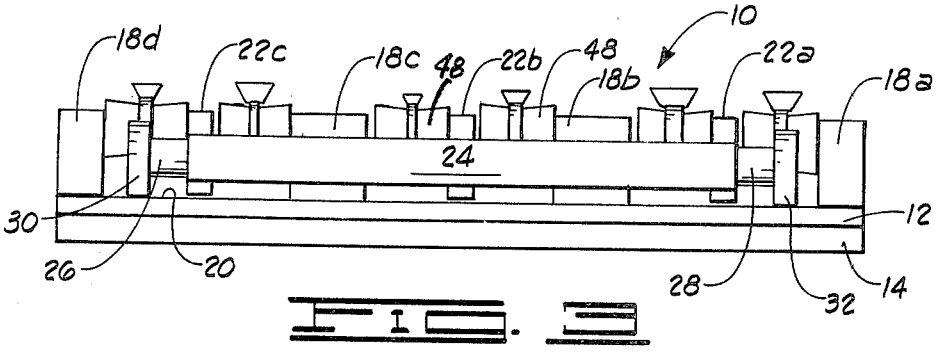
FIG. 3 is a left side view in elevation of the device of FIG. 1.

Referring to FIGS. 1, 2 and 3, a display tray 10 consists of a generally flat base member 12 having supporting or bracing structure 14 rigidly secured on the bottom or back side 16. A plurality of generally rectangular base bars 18*a–n* are rigidly secured in parallel disposition on the top surface 20 of base 12.

A plurality of movable bars 22*a–n* are disposed in parallel and are positionable generally half way between each adjacent pair of base bars 18 as the movable bars 22 are ridigly secured to a pivot bar 24. The pivot bar 24 is rigidly connected at opposite ends to pivot pins 26 and 28 which are rotatably engaged within respective hinge brackets 30 and 32. The hinge brackets 30 and 32 are rigidly secured in spaced disposition along one side of top surface 20 of base 12 such that pivotal movement of hinge bar 24 can place each of movable bars 22 approximately half way between each successive pair of base bars 18. Base bars 18 and movable bars 22 may be formed of different widths and cross-sectional configurations to enhance aesthetic appeal of display tray 10 so long as the critical spacings of adjacent bars is maintained.

Figure 4:
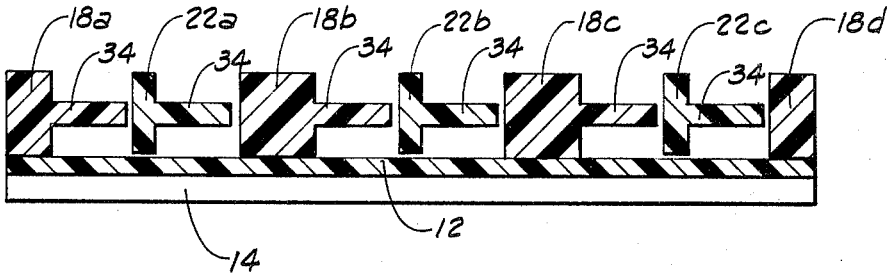
FIG. 4 is a vertical section taken along lines 4—4 of FIG. 1.

A plurality of rods 34 are rigidly secured at generally equally-spaced positions along and normal to each of the movable bars 22 and the base bars 18. The rods 34 are each bonded in doweled seating in the respective bars 18 and 22, and each of rods 34 are of a length that will extend from the respective seating bar to proximate, but not touching, the next adjacent bar. Thus, a mercantile item having a ring portion for inerlocking, such as a ring 36, will have a ring band of a thickness that will prevent its removal from a display position on rod 34 when in the locked position (See FIG. 4).

The remaining ends of movable bars 22*a–c* are each rigidly secured to a lock plate 38 which carries a lock 40 that may be utilized to secure the display tray bars in the interlocked display position. The lock 49 may include a simple pivot lever 42 which may be locked in catching position beneath a catch 44 that is suitably secured to top 20 of base 12. A spacer block 46 is also secured on base top 20 for contact with the underside of plate 38 to limit its downward travel and maintain alignment of the interlocking bar and rod assemblies.

The display tray 10 can be constructed using a wide variety of materials while practicing a number of different securing and fastening techniques. However, present construction is carried out utilizing rigid plastics as selected from commercially available sheet, bar and rod stock, with further blending of colors and textures to enable unusual and appealing aesthetic effects in the final display tray. Thus, when using the plastic stock forms, the rods 34 are counter-set and bonded with suitable glue into their respective bar supporting element. Further, all secure fastening connections are made using a suitable bonding agent which may be selected in accordance with the particular type of plastic.

Figure 5:
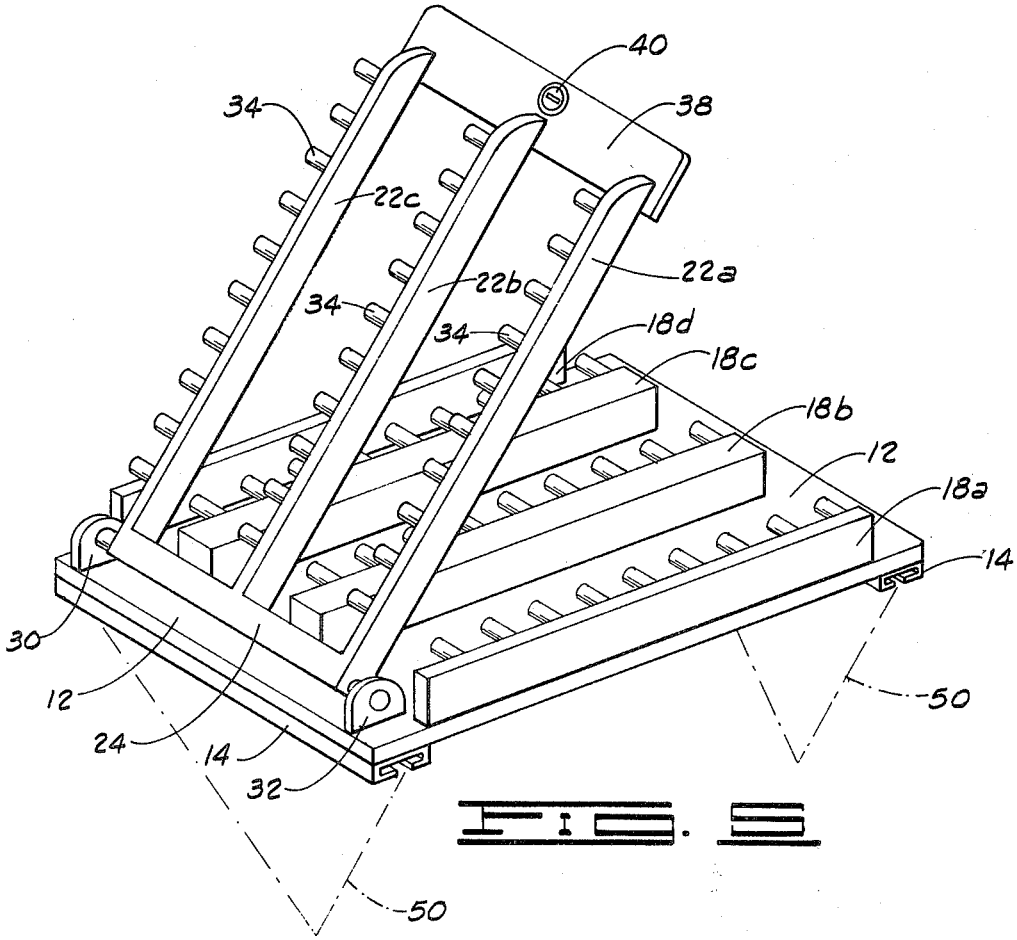
FIG. 5 is a perspective view of the invention in partially open and non-locking position.

In operation, the display tray 10 may be utilized by disengaging lock 40 and opening pivotally the movable bars 22 relative to the base bars 18 such that each of the rods 34 is simultaneously freed from locking enclosure and accessible for receiving a mercantile item ring portion, e.g. most specifically rings for the finger. When in the open position as shown in FIG. 5, each of the rods 34 is available for receiving a ring 36 thereover. It is preferred to position each ring 36 with a short section of a spacer tube 48 (FIG. 1) which fits through the ring 36 and over the rod 34. The spacer tubes 48 can themselves be formed of attractive material by cutting short lengths of commercially available insulation-type polyfoam tubing which is commercially available in any of a number of colors that can be effectively mixed and matched relative to the color scheme of the display tray 10.

After each of rods 34 has been filtered with a respective finger ring for display, the movable bars 22 are pivoted downward (FIG. 5) into parallel disposition relative to the base bars 18 and lock 40 is actuated to the closed position. In the closed position, and as shown most clearly in FIG. 1, each of rings 36 is captive on a respective rod 34 and cannot be removed therefrom due to the very close proximity of the rod 34 outer end to the next proximate movable bar or base bar (FIG. 4) as the case may be. The ring display is then available for use in tray form as it can be removed readily from the tray cabinet and left on top of a display case while demanding but minimal surveillance since individual rings cannot be removed from display tray 10. In the event of a selection, it is merely necessary to disengage lock 40 and open movable bars 22 whereby each ring retaining rod 34 is simultaneously free and the selected ring can be removed for closer inspection, sale and packaging.

It is contemplated that the display tray 10 will often be used in the flat tray form wherein the C-channel members 14 merely serve as rest supports. However, the C-channel members enable more versatile usage as angle brackets 50 having a suitable T-edge for insertion in C-channels 14 may be utilized to provide a stand-up display tray 10 that may be placed in front display windows, within display cases, or even out in an accessible but high surveillance area. It is further contemplated that various other forms of small mercantile items, e.g. ear rings, which have the characteristic of including a ring portion for capture over rod 34 and subsequent display, may also be utilized with the display tray 10 and/or various similar formations and constructions.

The foregoing discloses a novel display tray for mercantile items wherein a captive ring portion may be placed over a rod which is in an interlocked position when the display structure is moved into closure. The display tray can be constructed in various sizes, configurations, number of coacting bars, desirable colors and color matches, and diverse other attributes, all of which serve to heighten the desirability of the particular form of construction and enhance the adaptability to various forms and uses. In any of the various forms of construction, each of the mercantile item capture rods can be instantaneously freed by a simple movement of the interacting bar or longitudinal support members. While the specific embodiment shows the use of straight bar members, it should be understood that various forms of parallel curviform may also be utilized.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A display tray for mercantile items having a circuitous ring portion, comprising:

base means;

plural first bar means affixed in spaced parallel disposition on said base means;

first means disposed along n−1 of said first bar means for retaining a plurality of mercantile items;

at least one second bar means hingedly affixed to said base means and movable into display position between adjacent ones of said plural first bar means; and second means disposed along each of said at least one second bar means for retaining a plurality of mercantile items.

2. A display tray as set forth in claim 1 wherein said first and second means each comprise:

plural rods disposed in generally spaced parallel alignment as affixed along the respective bar means, each of said rods being adapted for interlocking reception through the ring portion of a respective mercantile item.

3. A display tray as set forth in claim 2 which is characterized in that:

said plural rods each extend proximate the next adjacent bar means when in the display position and the ring portions cannot be removed from their respective rod.

4. A display tray as set forth in claim 3 which further includes:

lock means for locking the display case in the display position.

5. A display tray as set forth in claim 1 wherein said at least one second bar means comprises:

hinge means disposed in rigid affixture on one side of said base means;

hinge bar means pivotally affixed to said hinge means; and at least one second bar means mounted normal to said hinge bar means.

6. A display tray for mercantile items having a circuitous ring portion, comprising:

a base member;

a plurality of n base bars secured generally parallel to each other on said base member;

a plurality of n−1 movable bars disposed in rigid parallel connection;

a plurality of rod means secured to extend generally normal from selected ones of said n and n−1 bars for retaining respective mercantile item ring portions thereover;

hinge means securing each of said n − 1 bars for locking positioning between each adjacent pair of said n base bars, and operable to swing said n − 1 bars to a second position to free simultaneously the mercantile item ring portions on said rod means.

7. A display tray as set forth in claim 6 which is further characterized in that:

an outermost one of said n base bars carries no rod means in affixure.

8. A display tray as set forth in claim 7 wherein said hinge means comprises:

a pivot bar means secured to each of said n − 1 bars; and hinge brackets secured to said base member and pivotally supporting said pivot bar means.

9. A display tray as set forth in claim 8 which is further characterized to include:

lock means actuable to retain each of said n − 1 bars in parallel position between a respective pair of said n base bars.

10. A display tray as set forth in claim 6 which further includes:

a plurality of resiient tubing means to be received between the rod means and the mercantile item to enable secure display positioning.

* * * * *